United States Patent [19]

Harrison et al.

[11] 4,115,241

[45] Sep. 19, 1978

[54] SOLVENT DEWAXING PROCESS

[75] Inventors: Charles W. Harrison, Nederland, Tex.; Paul P. Bozeman, Jr., deceased, late of Groves, Tex., by Arlene Bozeman, executrix

[73] Assignee: Texaco Inc., New York, N.Y.

[21] Appl. No.: 813,140

[22] Filed: Jul. 5, 1977

[51] Int. Cl.[2] ..... C10G 43/08

[52] U.S. Cl. ..... 208/33; 208/38

[58] Field of Search ..... 208/33

[56] References Cited

U.S. PATENT DOCUMENTS

| | | | |
|---|---|---|---|
| 2,410,483 | 11/1946 | Dons et al. | 208/37 |
| 3,350,297 | 10/1967 | Torobin | 208/33 |
| 3,720,599 | 3/1973 | Gould | 208/33 |
| 3,764,517 | 10/1973 | Bodemuller | 208/33 |
| 4,013,542 | 3/1977 | Gudelis et al. | 208/33 |

OTHER PUBLICATIONS

Chen et al., "Chemical Engineering", Mar. 19, 1973, pp. 105 to 111.

*Primary Examiner*—Herbert Levine
*Attorney, Agent, or Firm*—Carl G. Ries; Thomas H. Whaley; Douglas H. May, Jr.

[57] ABSTRACT

A solvent dewaxing process wherein a waxy oil charge, heated for melting wax therein, is cooled to a temperature about 5°-15° F below the cloud point, wherein the cooled waxy oil charge is mixed under conditions of good mixing with solvent having a temperature 20°-40° F above a selected separation temperature in a solvent to oil ratio of about 1:1 to 5:1 for precipitating wax from the resulting mixture, and wherein the wax/oil/solvent mixture is further cooled in a second cooling zone at a rate of ca. 1°-8° F./min to said selected separation temperature for precipitating additional wax. Precipitated wax is separated from the mixture at the separation temperature, producing a wax free solvent-oil solution. Dewaxed oil is recovered by fractionation from the wax free solvent-oil solution.

5 Claims, 1 Drawing Figure

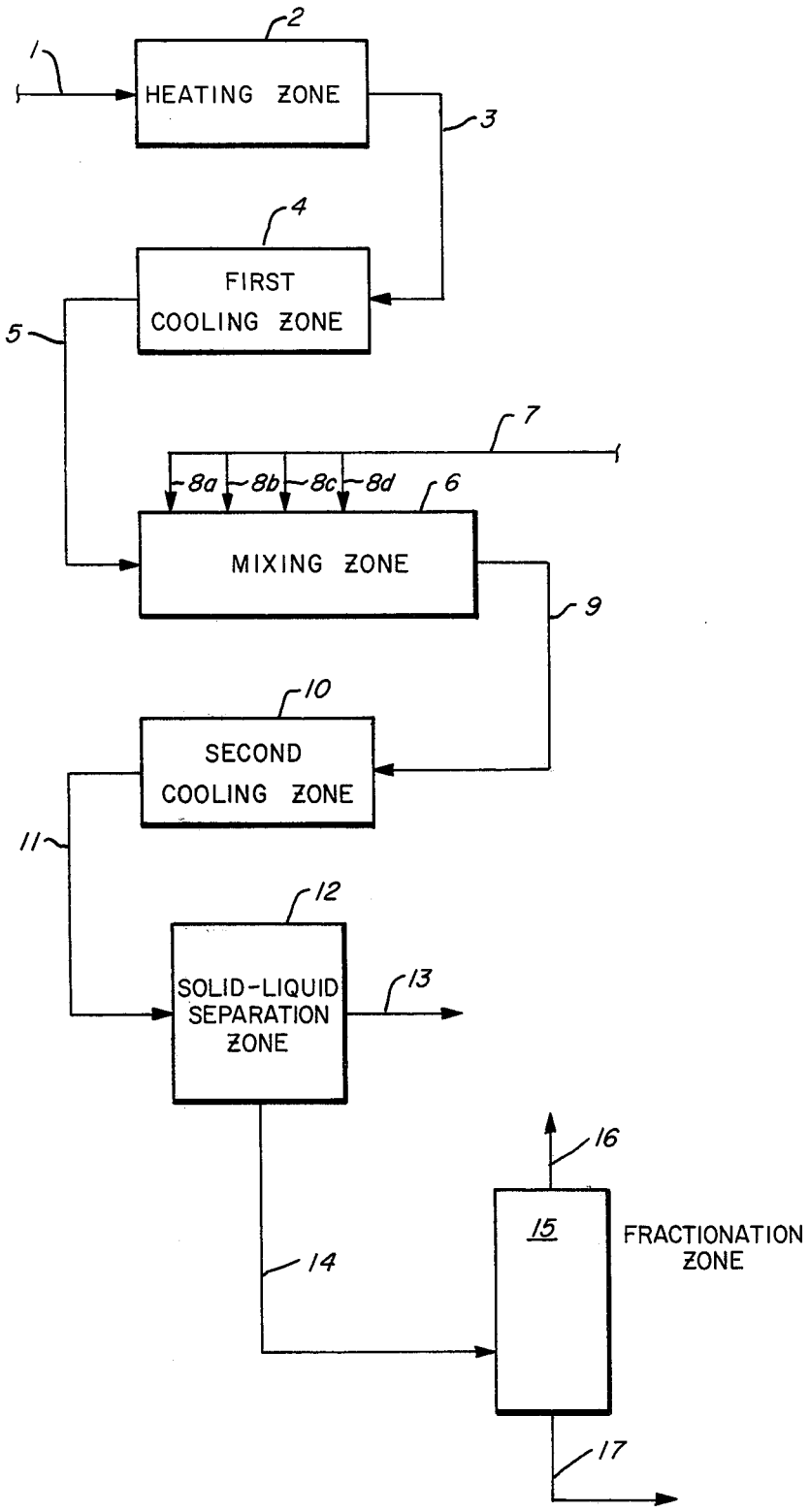
1
2
HEATING ZONE
3
4
FIRST
COOLING ZONE
5
7
8a
8b
8c
8d
6
MIXING ZONE
9
10
SECOND
COOLING ZONE
11
12
SOLID-LIQUID
SEPARATION
ZONE
13
16
15
FRACTIONATION
ZONE
14
17

SOLVENT DEWAXING PROCESS

BACKGROUND OF THE INVENTION

The present invention relates to a solvent dewaxing process for dewaxing waxy distillate petroleum oil stocks. More particularly, the invention relates to a solvent dewaxing process wherein a heated waxy distillate petroleum oil stock is cooled to a temperature in the range of about 0°-15° F. (0° to 8° C.) below the cloud point; wherein the cooled waxy oil stock is mixed with dewaxing solvent as one or more increments having a temperature about 25° to 40° F. (14° to 22° C.) above a selected separation temperature, for forming a mixture comprising wax crystals in an oil/solvent solution, and wherein the wax/oil/solvent mixture is cooled further at a uniform rate of about 1° to 8° F./min (0.56° to 4.4° C./min) to said selected separation temperature for crystalizing additional wax therefrom.

DESCRIPTION OF THE PRIOR ART

It is known in the prior art to dewax waxy petroleum oil stocks by cooling oil solvent solutions at uniformly slow rates, of e.g. 1° to 8° F./minute (0.56° to 4.4° C./min), under controlled conditions for crystalization of wax from said solutions. Commercially, such oil solvent solutions are cooled by several methods such as cooling by indirect heat exchange in scraped surface exchangers; dilution chilling wherein waxy oil stock is contacted in a multistage tower with chilled solvent under conditions of high levels of agitation (U.S. Pat. No. 3,773,650); and direct chilling, wherein a low boiling solvent, e.g. propylene, mixed with waxy oil stock is vaporized under conditions of reduced pressure. In such commercial processes, the waxy oil charge, or solutions of waxy oil charge and solvent, are heated to a temperature at which all the wax present is dissolved. The heated charge is then passed into a cooling zone wherein cooling is undertaken at a uniform slow rate in the range of about 1° to 8° F./minute (0.56° to 44° C./min.) until a temperature is reached at which substantial portion of the wax is crystalized, and at which dewaxed oil product has a selected pour point temperature. Upon achieving the desired dewaxing temperature, the mixture of wax crystals, oil and solvent is subjected to solid-liquid separation for recovery of a wax free oil-olvent solution, and a solid wax containing a minor proportion of oil (slack-wax). The separated oil-olvent solution is subjected to fractional distillation for recovery of a solvent fraction, and a product dewaxed oil fraction. The slack was may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter followed by solvent wash of the wax cake is employed.

Dewaxing solvents which may be used in such processes include known dewaxing solvents. Commonly used solvents include aliphatic ketones of 3-6 carbon atoms, $C_2$-$C_4$ range hydrocarbons, $C_6$-$C_7$ aromatic hydrocarbons, halogenated $C_1C_4$ hydrocarbons and mixtures of such solvents. Solvent dilution of waxy oil stocks maintains fluidity of the oil for facilitating easy handling, obtaining optimum wax-oil separation and obtaining optimum dewaxed oil yields. The extent of solvent dilution depends upon the particular oil stocks and solvents used, the approach to filtration temperature in the cooling zone, and the desired final ratio of solvent to oil in the separation zone.

For processes employing indirect cooling in scraped surface exchangers, cooling and wax crystalization is accomplished under conditions of very little agitation at a rate in the range of about 18° F./minute (0.56° to 4.4° C./min). Under such conditions, without wall scrapers, wax tends to accumulate on the cold exchanger walls, interferring with heat transfer, and causing increased pressure drop. Thus, scrapers are employed to remove the accumulated wax. Dewaxing solvents are employed to maintain fluidity of the oil in the coolers, and may be added before the oil is cooled or in increments during cooling.

Often the oil is given a final dilution with solvent at the separation temperature for reducing solution viscosity such that wax separation is more efficient. Commonly, solvent added to the oil in such processes is at the same temperature, or somewhat higher temperature, then the oil. Cold solvent, added at substantially lower temperatures than the oil, shock chills the oil, resulting in formation of many small wax crystals which are difficult to separate. Under controlled conditions, elongated wax crystals of good size are formed which are easy to separate and which contain little occluded oil.

Dilution chilling processes employ incremental addition of cold solvent, e.g. at temperatures lower than the separation temperature, to the oil under conditions of high degrees of agitation, such that oil and solvent are completely mixed in less than 1 second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution to facilitate separation of solid wax from the oil-solvent solution. The low boiling hydrocarbon is vaporized from the oil-low boiling hydrocarbon solution under conditions of reduced pressure, at a rate sufficient to cool the solution about 1°-8° F. per min. (0.56° to 4.4° C./min.). Such cooling is continued until the desired separation temperature and degree of waxy crystalization are obtained. At the separation temperature, sufficient low boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either scrapers or high speed agitators, are employed to facilitate good heat transfer from the oil. Such rotating mechanical equipment is expensive, difficult to maintain, and can contribute to breaking and deformation of wax crystals.

SUMMARY OF THE INVENTION

Now, according to the present invention we have discovered improvements to continous solvent dewaxing processes for separating solid wax from waxy distillate petroleum oil stocks, wherein a waxy oil stock is heated for dissolving all solid-wax is treated with dewaxing solvent in a volume ratio of solvent to oil stock in the range of 1:1 to 5:1 wherein said mixture of oil and solvent is cooled at a rate of about 1°-8° F. minute (0.56° to 4.4° C. minute) to a selected separation temperature in the range of about 0° F. to −40° F. (−18° to −40° C.) for forming a slurry of wax crystals in an oil-solvent solution, wherein said slurry is separated into a dewaxed oil-solvent solution and slack wax, and wherein said separated solution is fractionated to yield a sovent fraction and a dewaxed oil fraction; the improvement comprising:

(a) heating, in a heating zone, said waxy oil stock to a temperature, in the range of about 100°-160° F. (38° to 71° C.) at which all solid wax is melted into solution with the oil;

(b) cooling, in a first cooling zone, said heated waxy oil at a rate of about 1°-8° F./min (0.56° to 4.4° C./min.), under conditions of plug flow radial mixing to a temperature in the range of about 15° F. (0° to 8° C.) below the waxy oil stock cloud point;

(c) flowing said cooled waxy oil stock from step (b) into the inlet of a plug flow radial mixing zone;

(d) injecting, via a plurality of injection nozzles, dewaxing solvent into said mixing zone at a temperature in the range of about 20°-40° F. (11° to 22° C.) above a selected separation temperature in an amount equivalent to about 1-5 volumes of waxy oil stock at a rate to cool said waxy oil stock about 1° to 8° F./min (0.56° to 4.4° C./min) to a temperature below the depressed cloud point of the resulting mixture wherein each portion of solvent injected via said nozzles is mixed intimately, under conditions of plug flow radial mixing, with said flowing waxy oil stock before injection of the next following waxy oil stock increment;

(f) cooling, in a second cooling zone, said mixture of solvent and oil stock from the outlet of said mixing zone, at a rate of about 1° to 8° F./min (0.584.4° C./min), under conditions of plug flow radial mixing sufficient to limit transverse temperature gradients in the mixture to about 1° F. or less, to said selected separation temperature in the range of about +25° F. to 40° F. (to −40° C.) for crystallizing solid wax from said oil-mixture; and (g) flowing the mixture of wax crystals, oil, and solvent from said cooling zone to said solid-liquid separation zone.

Advantages of the present invention over processes of the prior art include elimination of rotating mechanical equipment such as wall scrapers and/or agitators from the dewaxing process. Elimination of rotating mechanical equipment reduces cost of constructing solvent dewaxing facilities, and reduces manpower, expense and down time required for operating and maintaining such rotating mechanical equipment.

Plug flow radial mixing in at least the first and fourth cooling zones results in improved heat transfer from the oil-solvent mixture and reduces operating costs by improving efficiency. However, the greatest advantage is that transverse temperature differentials across the cross-sectional area of flowing oilsolvent mixture, is reduced to about 1° F. (056° C.) or less, such that substantial subcooling of portions of the mixture close to the cold exchanger walls is avoided, thus reducing excessive deposition of wax. These advantages, and others will be explained more fully in the detailed description which follows.

BRIEF DESCRIPTION OF THE DRAWING

The drawing is a schematic representation of a solvent dewaxing process employing improvements of the present invention.

DESCRIPTION OF TERMS

Waxy petroleum distillate oil stocks contemplated as charge stocks to the solvent dewaxing process of the present invention have a viscosity of less than about 350 SUS at 100° F., and boil in the range of about 600° to 625° F. (315° to 330° C.) initial boiling point to about 1050° to 1100° F. (565° to 593° C.) end point. Such waxy petroleum distillate oil stocks may be derived from raw lube oil stocks, the major portion of which boil above 650° F. (343° C.). Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks.

Such distillate streams contain aromatic and polar compounds which are undesirable in lubricating oils. Such compounds may be removed, by means such as solvent extraction, hyrogenation, and other means well known in the art, either before or after solvent dewaxing. Treatment of waxy oil stocks for aromatic and polar compound removal before solvent dewaxing reduces the volume of oil to be dewaxed, which concomitantly reduces the amount of solvent employed, heat load, etc.

Wax content of a waxy distillate oil stock is defined by the amount of material to be removed to produce a dewaxed oil with a selected pour point temperature in the range of +25° to −40° F. (3.9° to −40° C.). Wax content of waxy distillate oil stocks will vary in the range of 5 to 35 wt. percent. The wax material removed in solvent dewaxing is a complex mixture of straight chain and branched chain paraffinic and naphthenic hydrocarbons. Wax in light distillate oil stocks generally predominantly comprises normal paraffin hydrocarbons which have relatively high crystal growth rates whereas wax in heavier distillate stocks comprises mixtures of normal and isoparaffin hydrocarbons having relatively slower crystal growth rates. In solvent dewaxing processes, was is separated as solid crystals.

Dewaxed oil, as the term is used herein, is the product from the dewaxing process after solid wax and solvent have been removed. Commonly, dewaxed oils derived from distillate oil stocks contemplated as charge stocks herein will have pour points in the range of about 0° to −25° F. (−18° to −32° C.).

Pour Point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The Cloud Point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture of solvents employed, etc.

Dewaxing solvents contemplated for use in the present invention include known dewaxing solvents. For example, dewaxing solvents may be selected from: aliphatic ketones of 3 to 6 carbon atoms; lower molecular weight hydrocarbons e.g. ethane, propane, butanes, and particularly propylene; Aromatic hydrocarbons such as benzene and toluene; halogenated low molecular weight hydrocarbons of 1 to 4 carbon atoms, e.g. dichlorethane, methylenechloride, etc; and mixtures of the above. Useful dewaxing solvent mixtures are: mixtures of methyl ethyl ketone and methyl isobutyl ketone; mixtures of ketones with propylene; mixtures of ketone with $C_6$–$C_7$ aromatic hydrocarbons and mixtures of dichloroethylene and methylene chloride. Particularly useful in the process of the present invention are mixtures comprising 30–70 volume percent methyl ethyl ketone and 70–30 volume percent toluene.

Solvent Dilution of waxy oil charge stock, in solvent dewaxing processes comprises diluting waxy oil charge stock with dewaxing solvent, in volume ratios in the range of about 1:1 to 5:1 solvent to oil, for improving wax removal from the oil, maintaining fluidity of the oil under cooling, or chilling, conditions in the dewaxing process, obtaining optimum wax separation rates, and obtaining optimum dewaxed oil yields. The extent of solvent dilution is dependent upon the particular waxy oil stock, the solvent system employed, the extent of cooling in the cooling zone, and the desired final viscosity of the wax/oil/solvent mixture going to the wax separation zone. In the prior art it is known that solvent may be added to waxy oil stock before cooling commences, (referred to as predilution), in increments as the oil stock is cooled, at the exit from the cooling zone, or by a combination of the above methods. One solvent may be added at one point in the solvent dewaxing process and another solvent at another point, or the same solvent, or mixture of solvents, may be employed throughout.

Generally, it has been observed that addition of a cold solvent e.g. at a temperature lower than the separation temperature, to a warmer waxy oil stock, must be accompanied by vigorous agitation for formation of large, easily separated wax crystals. Without vigorous agitation, cold solvent injected into warm waxy oil stock tends to form extremly small wax crystals which are difficult to separate.

Plug Flow Radial Mixing within contemplation of the present invention refers to mixing the solvent-oil mixture in a tubular mixing zone by splitting the flowing fluid into two or more strata each of which is then helically rotated in one direction about its hydraulic center, resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continously divided and redivided into strata which are continuously radially inverted, such that elements of the fluid entering at the center of the flowing stream are forced to the outer wall, and vice versa, on a continous basis. Such radial mixing is accomplished with very little backmixing such that the flow of fluid approximates plug flow. Flow of fluid may be in the laminer range or in the turbulent range. In such plug flow radial mixing, transverse gradients from the center to the wall of the mixing zone in temperature, velocity and composition are substantially reduced or eliminated. Additionally, heat transfer from the body of flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering,* Mar. 19, 1973, p. 105ff. In the present invention, plug flow radial mixing makes three important contributions to the process. Transverse temperature differences across the flowing fluid are reduced to 1° F. (0.56° C.) or less in the cooling zones, such that super cooled oil-solvent mixture does not reside at the cold wall, depositing wax thereon; the flow of oil-solvent mixture is directed at the cold wall, scouring away any wax which may accumulate; and, in the mixing zone, solvent and oil are rapidly blended into a mixture having a uniform temperature and composition throughout.

Cooling Rate of a waxy oil stock-solvent mixture or solution, in solvent dewaxing processes generally and the process of the present invention particularly, has been observed to be determinate of the size of wax crystals formed in the wax/oil/solvent mixtures. Lower cooling rates yield larger, easy to separate crystals, with less oil occluded therein. Conventionally, oil-solvent mixtures are cooled at uniform slow rates in the range of 1°–8° F. per minute (0.56° to 4.4° C./min). Preferably cooling rates are in the range of 1.5°–5° F. per minute (0.83° to 3° C./min). Although larger wax crystals containing less occluded oil are formed at lower cooling rates, economy demands that the rate be at least about 1° F per minute (0.56° C./min). At cooling rates above about 8° F. per minute (4.4° C./min), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystallization as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stocks, or oil-solvent mixtures, are cooled to the cloud point, a very large number of small wax crystal nuclei precipitate forming a haze or cloud in the mixture. Under conditions of uniform slow cooling, in the 1°–8° F. per minute (0.56° to 4.4° C./min) range, these small crystals tend to grow into larger, easily separable crystals at the expense of formation of additional small wax crystal nuclei as the temperature is reduced.

DESCRIPTION OF THE DRAWING

For better understanding the process of the present invention, reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, waxy petroleum distillate oil stock (waxy oil stock) having physical properties within ranges heretofore set-out in the specification, flows continuously, via line 1, into heating zone 2. In heating zone 2, the waxy oil stock is heated by indirect heat exchange to a temperature at which all wax present is melted and a completely liquid solution results, e.g. in the range of about 100°–160° F. (38° to 71° C.), for waxy oil stocks within contemplation of the present invention.

In the drawing, heated waxy oil stock having all wax dissolved therein flows from heating zone 2, via line 3, into first cooling zone 4. In cooling zone 4, the waxy oil stock is cooled at a rate in the range of 1°–8° F. per minute (0.56° to 4.4° C./min), preferably at a rate of 1.5° to 5° F./min (0.8° to 3° C./min), to a temperature in the range of 0°–15° F. (0° to 8° C.) below the cloud point. Preferably to a temperature about 5°–10° F. (3° to 6° C.) below the cloud point. This temperature of waxy oil stock exiting first cooling zone 4 (which will be in the range of about 70° to 120° F. (20° to 49° C.) for charge stocks contemplated herein) is critical for obtaining good dewaxing of the waxy oil stock. Should the waxy oil from cooling zone 4 be at a temperature above its cloud point, addition of solvent, as will be described below, results in depressing the cloud point substantially such that wax nucleation occurs at a much lower temperature under conditions which result in forming many very small wax crystals which are difficult to separate from the oil. Should the waxy oil stock from cooling zone 4 be at a temperature below the cloud point by more than about 15° F. (8° C.) when solvent is added, the wax crystals will contain much occluded oil which is difficult to separate. At waxy oil stock temperature in the range of about 5° to 10° F. (3°–6° C.) below the cloud point, addition of dewaxing solvent, as described below, results in large, easy to separate wax crystals which contain very little occluded oil. In cooling zone 4, it is preferable that the waxy oil stock be subject to mixing for preventing transverse temperature gradients and for ensuring that wax crystal nuclei which precipitate at the cloud point are distributed homogeneously within the waxy oil stock stream exiting first cooling zone 4. First cooling zone 4 may comprise a direct or an indirect heat exchanger, and mixing of the waxy oil stock may be provided by turbulent flow velocities, agitators, wall scrapers, or other mixing devices. Preferably, first cooling zone 4 is a double pipe heat exchanger equipped with static mixers, such that the waxy oil stock is subjected to plug flow radial mixing.

In the drawing, waxy oil stock, at a temperature about 0°–15° F. (0°–8° C.) below the cloud point, flows via line 5 into the inlet of mixing zone 6. Dewaxing solvent, from line 7 at a temperature in the range of about 20°–40° F. (11° to 22° C.) (which separation temperature is in the range of about +25° to −40° F.) above a selected separation temperature flows via nozzles 8A–D into mixing zone 6. Dewaxing solvent is selected from known dewaxing solvents, as heretofore set-out in this specification. Particularly useful dewaxing solvents are mixtures comprising about 30–70 vol. percent methyl ethyl ketone, and about 70–30 vol. percent toluene, although other dewaxing solvents such as mixtures of methyl ethyl ketone and methyl isobutyl ketone, and mixtures of ethylene dichloride and methyl chloride may be used to advantage. The amount of solvent may be in the range of 1–5 volumes of waxy oil stock, and, for example, is commonly in the range of about 2–4 volumes of waxy oil stock when the solvent is a mixture of methyl ethyl ketone-toluene. Dilution of lighter and heavier waxy oil stocks within contemplation of the present invention may require respectively somewhat less or somewhat more solvent for optimum effectiveness. The temperature of solvent entering mixing zone 6, within the range of about 20°–40° F., (11° to 22° C.) above the selected separation temperature is chosen such that the solvent will impart substantial direct cooling to the waxy oil stock, thus crystallizing wax from the oil, under conditions such that shock chilling is avoided. Direct cooling of waxy oil stock with solvent by mixing according to the process disclosed herein results in forming wax crystals having very little oil occluded therein and which are easily separated from the oil-solvent mixtures. This advantage, which forms an impetus for the improved process of the invention will be discussed in more detail throughout this description of the invention.

In the drawing, in mixing zone 6, waxy oil stock is mixed intimately with the dewaxing solvent from nozzles 8A–D under conditions of plug flow radial mixing to rapidly form a solution of oil and solvent and to cool this solution such that wax crystals are present in the oil-solvent solution exiting mixing zone 6. Dewaxing solvent is preferably injected into the waxy oil stream flowing in mixing zone 6 as a spray of fine droplets from nozzles 8A–D. Many nozzles designed for dispersing liquids as sprays of fine droplets are commercially available and are suited for use in this service. Accordingly, a first portion of solvent is injected in the form of fine droplets via first nozzle 8A into plug flow radial mixing zone 6 through which the waxy is oil stock is flowing. This first increment of solvent is thoroughly mixed with the waxy oil stock and the resulting solution has a temperature somewhat below the waxy oil stock temperature as it enters mixing zone 6. Wax crystallizes under these conditions, and the oil forms a solution with the solvent. Plug flow radial mixing distributes the wax crystals throughout the flowing stream. Upon through mixing of the first portion of solvent with waxy oil stock, a second portion of dewaxing solvent is injected as fine droplets via nozzles **8*b* into the flowing solution in plug flow radial mixing zone 6 wherein this second portion of cool solvent is thoroughly mixed with the flowing solution. Additional wax crystallizes from the waxy oil stock under these conditions, and tends to accumulate upon the wax crystal nuclei already formed. This injection of dewaxing solvent into the flowing solution continues in stages of solvent addition followed by through mixing until the desired volume ratio of solvent to oil, in the range of about 1/1 to about 5/1 is obtained. The exact number of injection nozzle 8 will vary with the dilution ratio of solvent/oil desired, and the solvent temperature. For effective crystallization of wax, the direct cooling of waxy oil stock with solvent in mixing zone 6** is maintained at an average rate of 8° F./min (4.4° C./min) or less, and preferably below 5° F./min (3° C./min). Otherwise shock chilling results, and too much of the wax is precipitated as small wax crystal nuclei, which because of their great number cannot grow to a size large enough for efficient separation from the oil-solvent solution.

In the drawing, the wax oil-solvent mixture from mixing zone 6 flows via line 9 into second cooling zone 10 for crystallization of additional wax. In cooling zone 10, the mixture is cooled at a uniform rate in the range of 1°-8° F. per minute (0.56° to 4.4° C./min), preferably 1.5°-5° F. per minute (0.83° to 3° C./min), to said selected separation temperature in the range of +25° to −40° F. (−4° to −40° C.). During this cooling step, additional wax crystallizes from the oil-solvent solution, thus decreasing the pour point of oil remaining in solution with the solvent. A major portion of wax crystallized in cooling zone 10 accumulates on wax nuclei already present, causing the wax crystals to grow into large easily separable wax crystals. Cooling in cooling zone 10 is continued until sufficient wax is crystallized such that the dewaxed oil product has a desired pour point in the range of about 0° to −40° F. (−18° to −40° C.) or lower. Cooling in cooling zone 10 is contemplated to be via indirect heat exchange with a refrigerant fluid or via direct heat exchange by vaporizing a portion of a dewaxing solvent, such as propylene, at reduced pressure.

In the drawing, wax-oil-solvent mixture, at the selected separation temperature obtained in cooling zone 10, flows via line 11 to solid-liquid separation zone 12 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commercial processes, wax is separated from oil-solvent solutions by vacuum filtration. That is, wax-oil-solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or a scraper such as a doctor knife, and the rotating drum carries the filter cloth into the holding tank for contact with additional wax-oil-solvent mixture.

In the drawing, wax from solid-liquid separation zone 12, known as slack wax and containing some oil entrained therein, is recovered via conduit 13 for further refining or for recovery as is. Separated, wax freeoil-solvent solution, as filtrate from solid-liquid separation zone 12, flows via line 14 to fractionation zone 15. In fractionation zone 15, the oil-solvent solution is separated into a solvent fraction which is recovered via overhead line 16, and a dewaxed oil fraction which is recovered as product via line 17.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is performed for removing wax from the waxy charge stock, thereby lowering the pour point temperature to a value suitable for the particular lubricating oil being manufactured. Other refining processes, outside the scope of the present invention, such as sovent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is relatively low volume operation compared to other petroleum refining operations. Consequently in commercial solvent dewaxing operations it is common practice to process one waxy oil stock at one time and other waxy oil stocks at other times in blocked out operation.

Heating waxy oil stock in heating zone 2 is preferably by indirect heat exchange from a heating medium such as steam, hot gas, or other heat transfer fluid to the waxy oil stock. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock primarily by convection. Maximum temperatures necessary for dissolving all the wax in the light waxy oil stocks contemplated for processing according to the present invention do not exceed about 160° F. (70° C.) and commonly do not exceed about 130° F. (54.4° C.). Consequently, heat exchangers having high radiant heat flux, and hot tube walls, such as direct fired heaters, are not preferred for this service.

In mixing zone 6, solvent from nozzles 8 is mixed with flowing waxy oil in a series of steps each comprising injection of a portion of the solvent into the waxy oil followed by plug flow radial mixing to thoroughly mix the oil and solvent. Preferably each portion of solvent is injected into the waxy oil via nozzles 8 as a fine spray of droplets. Such injection improves mixing of the oil and solvent. Plug flow radial mixing of oil and solvent following each solvent injection point provides through mixing of oil and solvent without use of rotating mixing equipment, consequently construction, operating and maintenance expenses are substantially reduced over conventional dewaxing processes. Plug flow radial mixing, as previously described, comprises a series of steps wherein the flowing stream to be mixed is divided into strata, and each strata is rotated about its hydraulic center, forcing liquid from the center of the flowing streams to the outer walls, and liquid from the outer walls to the center. The next succeeding mixing step redivides the strata from the first step into new divisions, each comprising portions of all the strata from the first step, and rotates the new divisions in the opposite direction about their hydraulic center. Thus in each mixing step, each strata of the liquid (in this case waxy oil stock and solvent) is mixed, and in the next succeeding step, portions of each strata are mixed with each other. In order to obtain the degree of mixing desired for waxy oil and solvent in the present process, upon injection of each portion of solvent, from about 100,000 to about 1,000,000 divisions and redivisions (strata) of the waxy oil and solvent are required. This degree of mixing requires from about 9 to about 20 mixing elements in the plug flow radial mixer following each point of oil injection. The number of mixing elements will be determined by the degree of mixing and the type of mixer selected. Some commercially available plug flow radial mixers divide the flow into two strata at each step, and some mixers divide the flow into four strata at each step.

In plug flow radial mixing, a discreet amount of mixing is accomplished by each element at each step. Thus, unlike agitation, where more or less mixing at each stage can be accomplished by increasing or decreasing residence time or agitator speed in that stage, residence time does not contribute substantially to the degree of mixing. In plug flow radial mixing, the liquid to be mixed must pass through a certain number of stages for a certain degree of mixing. In the present invention, relatively rapid mixture of waxy oil into solvent following each injection point in the mixing zone is desirable. As each element of the plug flow radial mixers occupies a length of equivalent about 1.5 diameters of the tubular mixing zone, and as mixing zones for commercial scale solvent dewaxing units may conveniently be about 6 inches (15.24 cm) in diameter, a minimum velocity of about 0.5ft/sec (0.15 m/sec) for solvent and oil in the mixing zone is desirable. Stated in a more generalized way, the preferred minimum velocity of solvent and oil in the mixing zone is equivalent to about one mixing zone diameters per second. A maximum to the flow velocity of waxy oil and solvent in the mixing zone is also desirable. This maximum is preferably equivalent to about eight mixing zone diameters per second (about 4 ft/sec. (1.22 m/sec) for a 6 inch (15.24 cm) diameter). Upon injection of cool solvent into the warmer waxy oil, small regions of temperature discontinues develop, which are equilibrated as the oil and solvent are thoroughly mixed. In cooler regions, wax nuclei will form, while in warmer regions wax will remain in solution. As the oil and solvent are mixed and the temperature equilibrates, some of the lower melting point wax nuclei formed in the cooler regions will melt and some wax from the warmer regions will crystallize as wax nuclei. This melting and crystallization of wax, that is equilibration of wax nuclei, takes a little time, and it is desirably completed before the next succeeding injection of oil. The maximum velocity equivalent to about eight mixing zone diameters gives sufficient time for the wax nuclei to equilibrate as the waxy oil-solvent temperature is equilibrated.

Cooling in second cooling zone 10 is preferably via indirect heat exchange with a refrigerant fluid, preferably in double pipe heat exchangers under turbulent flow conditions. Such double pipe heat exchangers may be equipped with scrapers for removing any deposited wax from the cold exchanger walls. Preferably, however, such rotating mechanical equipment is replaced with stationary plug flow radial mixers. Plug flow radial mixing of the wax-oil-solvent mixture in cooling zone 10 reduces transverse temperature differentials across the flowing mixture to about 1° F. or less, such that super cooling of the mixture at the cold wall, and concomitant precipitation of low melting point wax at the cold wall are avoided. Precipitation of low melting point wax, in a cold zone near the cold wall produces two undesirable effects. The low melting point wax, is tacky or sticky. This sticky wax then tends to stick to the cold wall of the exchanger, contributing to wax build-up, decreased heat exchange rates, increased pressure drops, etc. Also, the sticky wax tends to agglomerate into irregular shaped larger particles containing substantial amounts of occluded oil, thereby contributing to decreased dewaxed oil product yields. As stated above, plug flow radial mixing of the wax-oil-solvent mixture in cooling zone 10 eliminates cold liquid at the walls of the heat exchanger, thus the low melting point wax is not precipitated until the entire body of flowing solvent-oil mixture is cooled to the crystallization temperature. Consequently the wax crystals formed are not sticky and do not tend to accumulate on the heat exchanger wall. Also, in plug flow radial mixing, the flowing mixture is directed at the heat exchanger wall, thus scouring away any wax which may accumulate thereon. Additionally, with plug flow radial mixing in the cooling zone, wax tends to crystallize evenly throughout the flowing wax-oil-solvent mixture such that mass transfer of crystallizing wax from oil-solvent solution to an existing wax crystal is improved. Such improved mass transfer increases the growth rate of wax crystals and decreases the rate of wax crystal nuclei formation in the cooling zone.

For some existing solvent dewaxing units employing double pipe heat exchangers having rotating wall scrapers, the refrigerant fluids for cooling the oil-solvent mixtures may be at temperatures substantially lower than the oil-solvent mixtures, such that the exchanger walls are quite cold. In such cases, wax may tend to accumulate upon such cold walls when plug flow radial mixing is employed. However, since plug flow radial mixing substantially improves heat transfer rates, refrigerant temperatures may be increased and the desired range of cooling rates maintained. If revisions to existing refrigerant fluid systems are not practical, then scraped wall exchangers may continue to be employed in those exchangers where wax tends to accumulate, and plug flow radial mixers may be used where wax accumulation is less of a problem.

EXAMPLE

In order to demonstrate the process of the present invention, the following example is provided. A solvent neutral oil (SAE-5 grade) derived from Arabian Light crude is dewaxed according to the process of the present invention. Physical properties of the SAE-5 grade oil are given in Table I, below:

TABLE I

| SAE-5 GRADE OIL | |
|---|---|
| Refractive Index, 70° C | 1.4532 |
| Density/70° C (g/ml) | 0.8918 |
| Density/15° C (g/ml) | 0.8577 |
| Pour Point, (° C | +29 |
| Vis./100° F (Cp) | 16.73 |
| Vis./210° F (Cp) | 3.66 |
| Viscosity Index | 114 |

In the example process, SAE-5 grade oil is heated for melting all wax therein. The heated SAE-5 is then cooled to 30° C., which is about 1.8° C. (3.2° F.) below the cloud point, at a cooling rate of 1° C./min (1.8° F./min) under conditions of plug flow radial mixing in a first cooling zone comprising a double pipe heat excharger equipped with Kenics TM static mixers.

From the first cooling zone, the SAE-5 grade oil, at 30° C. is flowed to a mixing zone, and solvent comprising 70 vol.% MEK and 30 vol.% toluene, is flowed at a rate equivalent to 3.5 times the flow rate of SAE-5 grade oil, into the mixing zone at an entering temperature of −10° C. (+14° F.). The mixing zone comprises a pipe having four nozzles for injection of solvent spaced along its length with Kenics (TM) mixers of 20 elements each following each injection nozzle. The nozzles comprise restriction orifices which distribute the injected solvent as fine droplets into the flowing SAE-5 grade oil. In the mixing zone, SAE-5 grade oil and solvent are thoroughly mixed to produce a homogeneous mixture of wax crystals suspended in oil/solvent solution. This wax/oil/solvent mixture is flowed from the mixing zone through a second cooling zone comprising double pipe exchanger having Kenics TM mixers therein, wherein the mixture is cooled at a rate of 1° C./min (1.8° F./min) to a temperature of −25° C. (−13° F.). In the second cooling zone, additional wax is crystallized causing the wax nuclei to grow into filterable crystals.

From the second cooling zone, the wax-oil-solvent mixture is transferred to a vacuum filter operating at 400 mm Hg pressure wherein wax is filtered from the oil-solvent mixture. Upon filtration, the wax filter cake is washed with an amount of solvent equivalent to 2.65 volumes of SAE-5 grade oil charge, and the solvent washed wax cake is air dried for 60 seconds. Dewaxed oil is recovered from the wax free filtrate by fractional distillation.

Results of this experiment are shown in Table II, below:

TABLE II

| Filler rate (kg. oil m2 filter/ hr) | Dewaxed Oil Yield (wt % SAE-5 | Dewaxed Oil Pour Point | Wax Yield (wt. % SAE-5) | Wax Cake Oil Content (wt. % SAE-5 |
|---|---|---|---|---|
| 221 | 76.2 | −19 | 17.3 | 1.5 |

Dewaxed oil, having a pour point of −19° C., is recovered in an amount equal to 76.2 weight percent of the SAE-5 grade oil charge to the process. Slack wax in an amount equivalent to 17.3 wt.% of the SAE-5 charge is recovered, having entrained therein oil equivalent to 1.5 wt.% of the SAE-5 charge. About 5 wt.% of the oil remained unrecovered as system losses and entrained in the solvent.

Thus, by following the method of the present invention, dewaxed oil of low pour point suitable for use in manufacturing lubricating oils may be produced in good yields. Additionally, slack wax having low amounts of oil entrained therein is also recovered. The process of the present invention does not utilize rotating mechanical equipment such as wall scrapers or agitators. Consequently, it offers advantages of simpler, less expensive construction and operation compared to solvent dewaxing processes known in the prior art.

We claim:

1. In a continuous process for separating wax from a waxy distillate oil stock having an initial boiling point in the range of 600° to 625° F. and an end point in the range of about 1050° to 1100° F., wherein said waxy oil stock is treated with dewaxing solvent in a solvent to oil volume ratio of from about 1:1 to about 5:1, wherein said oil-solvent mixture is cooled to a selected separation temperature for crystallizing wax from said mixture, wherein solid wax is separated, in a solid-liquid separation zone, from the solvent-oil mixture, and wherein said separated solvent-oil mixture is fractionated, in a fractionation zone, into a solvent fraction and a dewaxed oil fraction; the improvement which comprises:

(a) heating, in a heating zone, said waxy oil stock, undiluted by dewaxing solvents, to a temperature at which all wax is in solution;

(b) cooling, in a first cooling zone, said heated waxy oil by indirect heat exchange with refrigerant fluids under conditions of plug flow radial mixing to a temperature about 0°–15° F. below the waxy oil cloud point temperature;

(c) mixing in a mixing zone, said cooled waxy oil from step (b) with dewaxing solvent, having a temperature about 25°–40° F. above said separation temperature, in a volume ratio of solvent to oil from about 1:1 to about 5:1, under conditions of plug flow radial mixing, for precipitating wax and forming a wax/oil/solvent mixture;

(d) cooling, in a second cooling zone said wax/oil/-solvent mixture from step (c) at a rate of about 1°–8° F. per minute, to said separation temperature for crystallizing wax from said solvent-oil mixture; and (e) flowing the wax/solvent/oil mixture from step (d) to said solid-liquid separation zone at said separation temperature.

2. The process of claim 1 wherein, in the mixing zone, dewaxing solvent is injected into waxy oil stock in increments such that cooling proceeds at a rate of about 1°–8° F./min, and wherein each increment of solvent is thoroughly mixed with waxy oil stock via plug flow radial mixing before the next increment of solvent is injected.

3. The method of claim 2 wherein dewaxing solvent is injected as a fine spray of liquid droplets into the waxy oil stock.

4. The method of claim 3 wherein, in the second cooling zone, the wax/oil/solvent mixture is cooled under conditions of plug flow radial mixing.

5. The method of claim 4 wherein cooling in said first cooling zone and said second cooling zone is by indirect heat exchange with refrigerant fluids.

* * * * *